US005919032A

United States Patent [19]

Naudet et al.

[11] Patent Number: 5,919,032

[45] Date of Patent: Jul. 6, 1999

[54] BLADED DISK WITH THREE-ROOT BLADES

[75] Inventors: Jacky Naudet, Bondoufle; Christophe Poy, Boissy le Cutte, both of France

[73] Assignee: Societe Nationale d'etude et de Construction de Moteurs d'Aviation "Snecma", Paris, France

[21] Appl. No.: 09/003,635

[22] Filed: Jan. 7, 1998

[30] Foreign Application Priority Data

Jan. 16, 1997 [FR] France ..... 97 00383

[51] Int. Cl.[6] ..... B63H 1/20; F01D 5/30

[52] U.S. Cl. ..... 416/216; 416/217; 416/221

[58] Field of Search ..... 416/215, 216, 416/217, 218, 219 R, 220 R, 221

[56] References Cited

U.S. PATENT DOCUMENTS

| | | | |
|---|---|---|---|
| 846,739 | 3/1907 | Farquhar | 416/215 |
| 1,500,787 | 7/1924 | Anderson . | |
| 1,638,639 | 8/1927 | Marsland . | |
| 2,327,839 | 8/1943 | Zschokke | 416/215 |
| 2,639,119 | 5/1953 | Greenwald . | |
| 2,751,189 | 6/1956 | Ledwith | 416/217 |
| 2,847,187 | 8/1958 | Murphy | 416/221 |
| 2,928,651 | 3/1960 | Turnbull | 416/221 |
| 3,014,695 | 12/1961 | Rankin et al. | 416/220 R X |
| 3,282,561 | 11/1966 | Frankel et al. | 416/216 |
| 3,383,094 | 5/1968 | Diggs | 416/221 |
| 3,986,779 | 10/1976 | Beckershoff | 416/221 X |
| 4,008,000 | 2/1977 | Gradl et al. | 416/218 X |
| 4,101,245 | 7/1978 | Hess et al. | 416/221 X |

FOREIGN PATENT DOCUMENTS

| | | |
|---|---|---|
| 0 274 978 | 7/1988 | European Pat. Off. . |
| 570 560 | 5/1924 | France . |
| 2 078 097 | 11/1971 | France . |
| 2 375 440 | 7/1978 | France . |

*Primary Examiner*—John E. Ryznic

*Attorney, Agent, or Firm*—Oblon, Spivak, McClelland, Maier & Neustadt, P.C.

[57] ABSTRACT

The blades (10) of a turbine or a compressor are here fixed to the disk (1) by three roots (7, 8 and 9) inserted in the same number of circular grooves (4, 5 and 6). This assembly makes it possible to provide a good distribution of stresses during functioning.

4 Claims, 4 Drawing Sheets

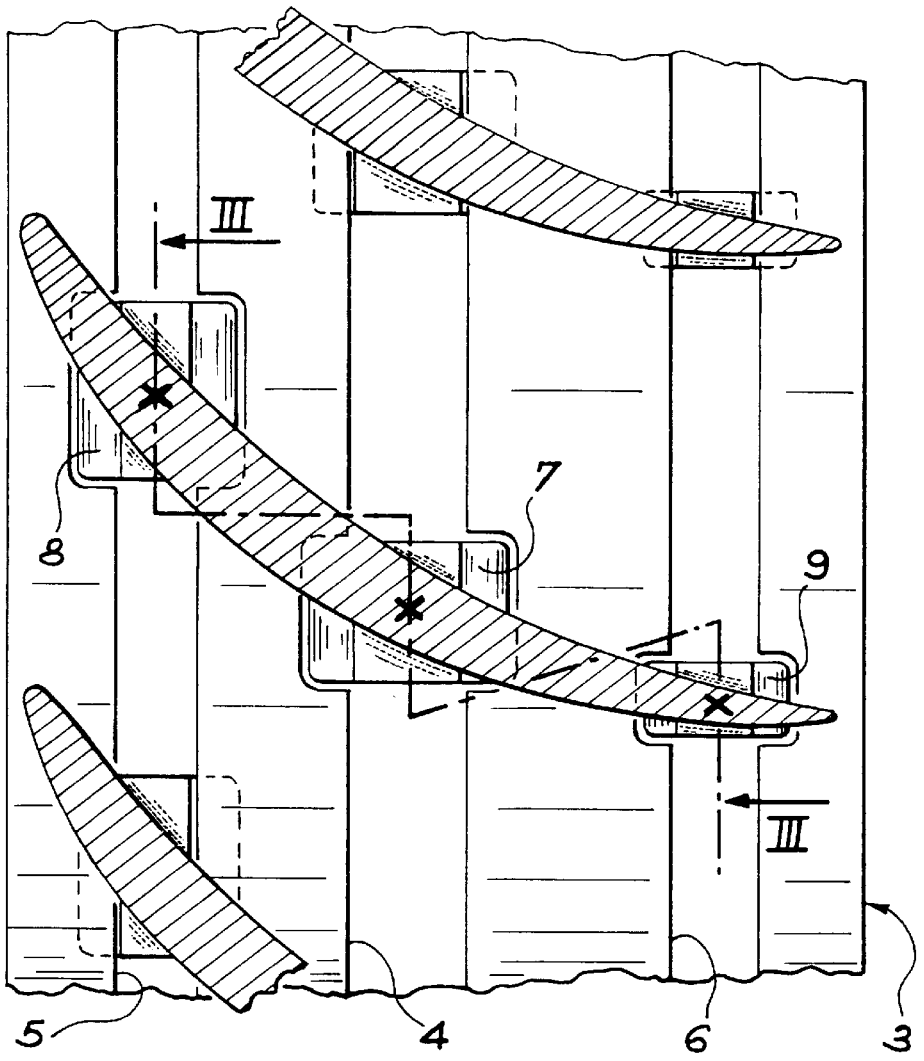
FIG. 2
FIG. 5
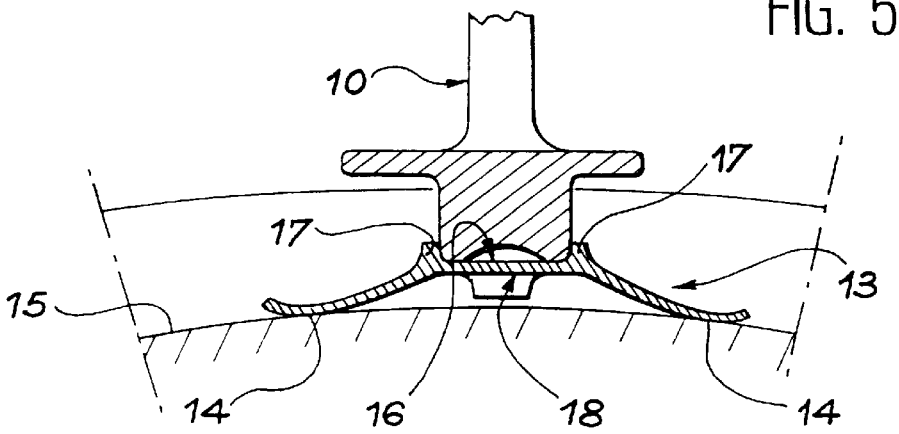

BLADED DISK WITH THREE-ROOT BLADES

DESCRIPTION

This invention concerns a bladed disk with three-root blades.

The turbines and compressors of machines such as gas turbines all comprise bladed disks. Leaving aside the rare cases of disks and their accompanying blades made in a single piece, there is a wide variety of practical embodiments for the connecting of blades and disk. These embodiments may, however, be divided into two fairly distinct families: the family of broached disks and that of circular groove disks.

In the former family, a broaching machine forms grooves of axial, oblique, rectilinear or circular arc direction through the width of the outer ring of the disk; the blades are inserted around the disk by sliding their roots along the broachings, and the nodular-section roots lock into the broaching so as to prevent the blades from being extracted. FIG. 6 illustrates an example in which the roots of blades 20 are curved and plugged into broachings 22 of complementary shape situated on the periphery of an outer ring 23 of the disk, joined to a narrower central part 24 of the disk. In the latter family, a single groove stretches over the circumference of the outer ring of the disk and all the roots of the blades are inserted in it.

The disadvantage of embodiments belonging to the first family is that the very heavy stresses to which the blades 20 are subjected during functioning are not spread evenly over the disk: they are exerted on the entire width of the outer ring, and only a small part is transmitted to the narrower central part 24, with the rest of the stress being concentrated on the projecting edges of the ring. This results in major stress irregularities in the disk and in particular in the outer ring, whose edges are heavily loaded, especially at the zones 25 located on the sides of the outer ring 23, between the broachings 22 and near the periphery of the ring. By way of contrast, the second family of embodiments provides a fairly uniform distribution of stress in the disk, the groove being situated in the plane of the central part, but its disadvantage is that the blade roots occupy less extended groove portions than a broaching extending in the width of the ring, and must therefore be less voluminous. This family of embodiments is more particularly designed for small blades which are not subjected to such heavy stress.

The invention constitutes, for the second family, an improvement for assembling blades to a disk. It retains this family's inherent advantage of good stress uniformity while transmitting appreciably higher levels of stress than is possible with known embodiments.

In conformity with the invention, three circular grooves are made in the bladed disk, the said grooves being penetrated respectively, for each blade, by three blade roots situated at different angles of the disk, These roots are, moreover, directed along the rotation axis of the disk. In addition, the grooves have different sections and the blade roots, too, have different sections. The grooves may advantageously be placed at different distances from the rotation axis of the disk, with the same aim of transmitting high levels of stress according to the shape (cylindrical or conical) of the disk.

According to another aspect of the invention, shock-absorbers may be placed between the blade roots and the bottoms of the grooves so as to reduce vibrations.

It should be noted that document FR-2375440-A describes three-root blades but these are assembled in helical grooves and thus concern the first family of embodiments. On the other hand, the device described in document U.S. Pat. No. 2,639,119 A belongs to the same family of embodiments as that of the invention; it describes multi-groove blades (at least four in the illustrated embodiments) in which the respective roots of the disk are inserted and retained by a forging. But the grooves and roots all have the same section and their number varies according to the width of the blades and the disk. It is not possible, with such an arrangement, to adjust the stresses and constraints over the surface of liaison between the blade and the disk, while the number of roots signifies that they all have a small section. This double disadvantage makes it impossible to transmit the same stresses as with the invention between the blades and the disk. The same comments apply to document U.S. Pat. No. 1,638,639 A.

Finally, mention must be made of document FR 2 078 097 A which describes an arc-shaped spring, analogous to the shock-absorber of the invention but not positioned in the same place and whose sole purpose is to retain the series of blades in the groove against the angular slips and to prevent them from reaching the widening of the groove through which they are inserted at the assembly stage.

A clearer picture of the invention will now emerge from a reading of the comments accompanying the following figures:

FIG. 2 is another view of this embodiment, the disk being seen from the outside in radial direction;

FIG. 5 represents an element of the assembly; and

Figure 1:
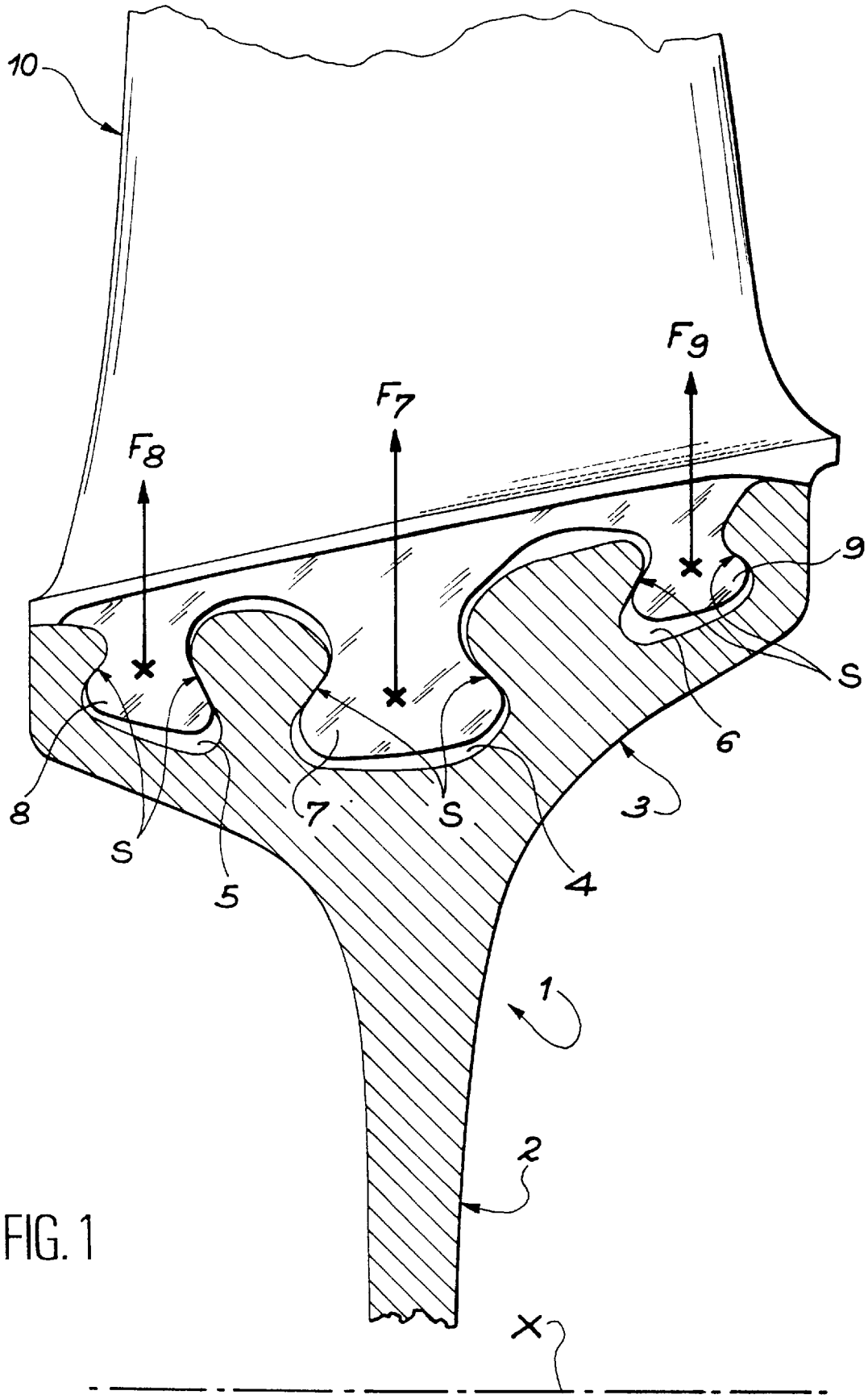
FIG. 1 is a diametrical section view of an embodiment of the invention.

The disk conforming to the invention is marked 1 on the figures in which may be distinguished a thin and flat central part 2. An outer ring 3 is connected to the edge of the central part 2, in which said ring a central groove 4 and two lateral grooves 5 and 6 flanking the central groove 4 have been made, all three grooves being circular and opening towards the exterior of the ring 3.

The three grooves 4, 5 and 6 are narrow at their opening portion so as to retain respectively three nodular roots 7, 8 and 9 of blades 10. When the disk 1 turns, driving the ring of blades 10, the said rings are subjected, under the influence of centrifugal, aerodynamic and vibrating forces, to principally radial stresses transmitted to the disk 1 by three components F7, F8 and F9 passing respectively by the roots of the 30 same reference number. In this way the stresses in disk 1 are spread more evenly than would be the case if only the central groove 4 and its root 7 were available, as with previous conceptions. The forces F7, F8 and F9 are transmitted to the ring 3, and hence to the rest of the disk 1, by means of three pairs of contact surfaces S between the lateral sides of the grooves 4 to 6 and the roots 7 to 9; by optimizing the positions and surface areas of these surfaces, only minor constraint concentrations are obtained in the disk 1, particularly in the ring 3. It may be seen that the sections of the rings 4, 5 and 6, and those of the roots 7, 8 and 9, are in fact different. Moreover, they are placed at different distances from the rotation axis of the disk whose periphery may be cylindrical or conical according to the usual dimensioning requirements of the machines. The presence of only three roots 7, 8 and 9 (one central and two lateral roots) makes it possible to predict exactly the stresses F7, F8 and F9 passing through each one of them, which would not necessarily be the case if there were a greater number of roots, in which latter case, moreover, the grooves would have to be tightened and made narrower, the result being to reduce the sections and thus the resistance of the roots. However, since such work is empirical and can only be carried out by laboratory tests or calculation simulations, and since moreover the result will largely depend on the actual shapes of the blades 10 (in particular their camber) and the disk 1, no general rules can be given.

Figure 3:
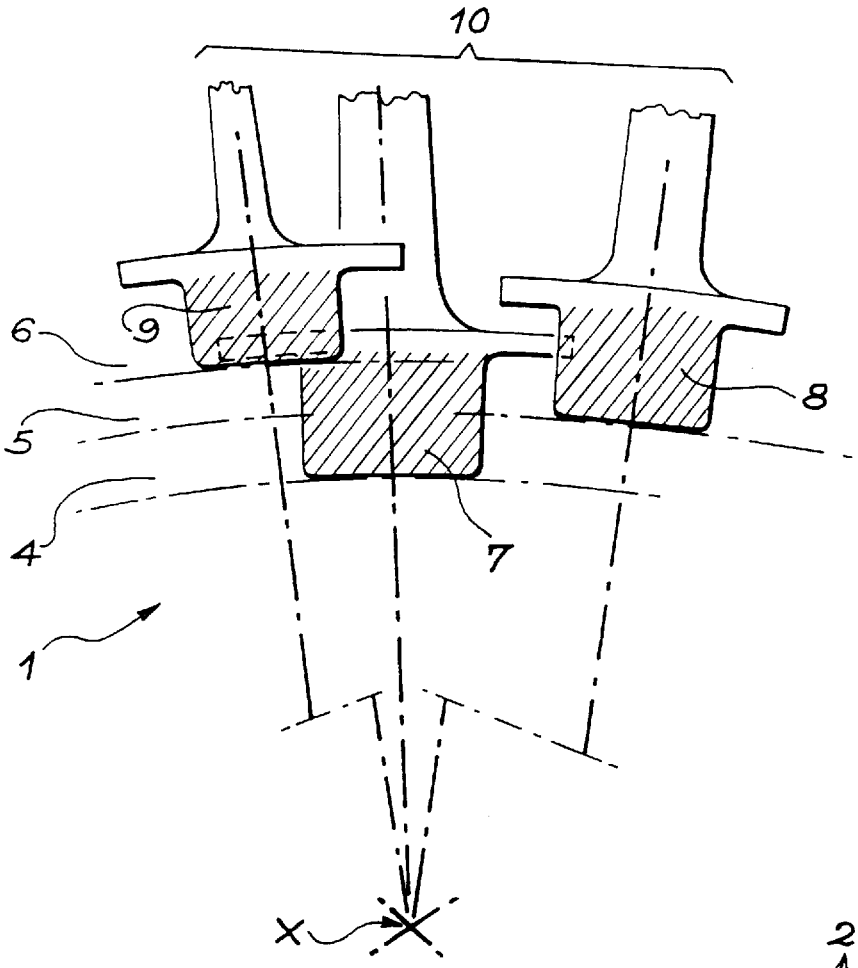
FIG. 3 is a triple cross-section view of the blade roots and the disk, taken along line III—III of FIG. 2.
Figure 6:
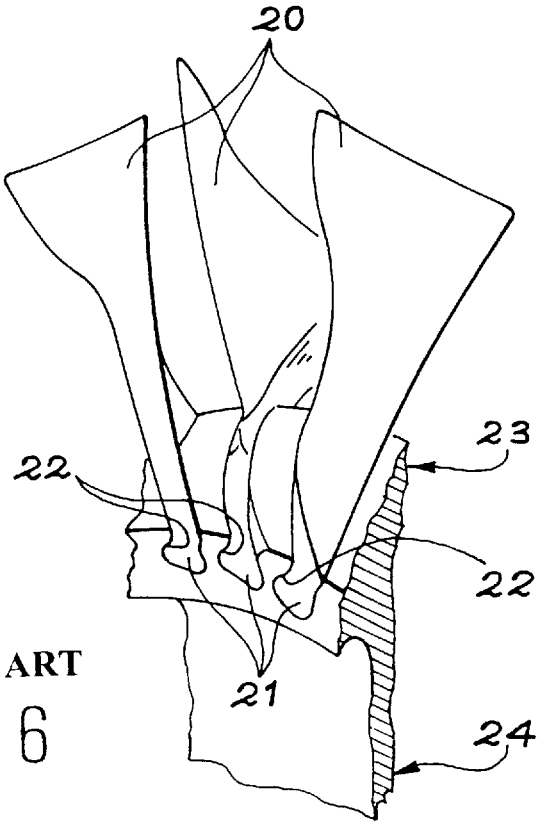
PRIOR ART FIG. 6
FIG. 6 is a view of the prior art.

FIG. 2 shows that the camber of the blades 10 forces the roots 7, 8 and 9 to be placed at different angles of the circumference of the disk 1. However, as FIG. 3 makes clear, the roots 7, 8 and 9 are not parallel but directed along the rotation axis X of the disk 1, thereby favoring the uniform spread of the constraints.

Figure 4:
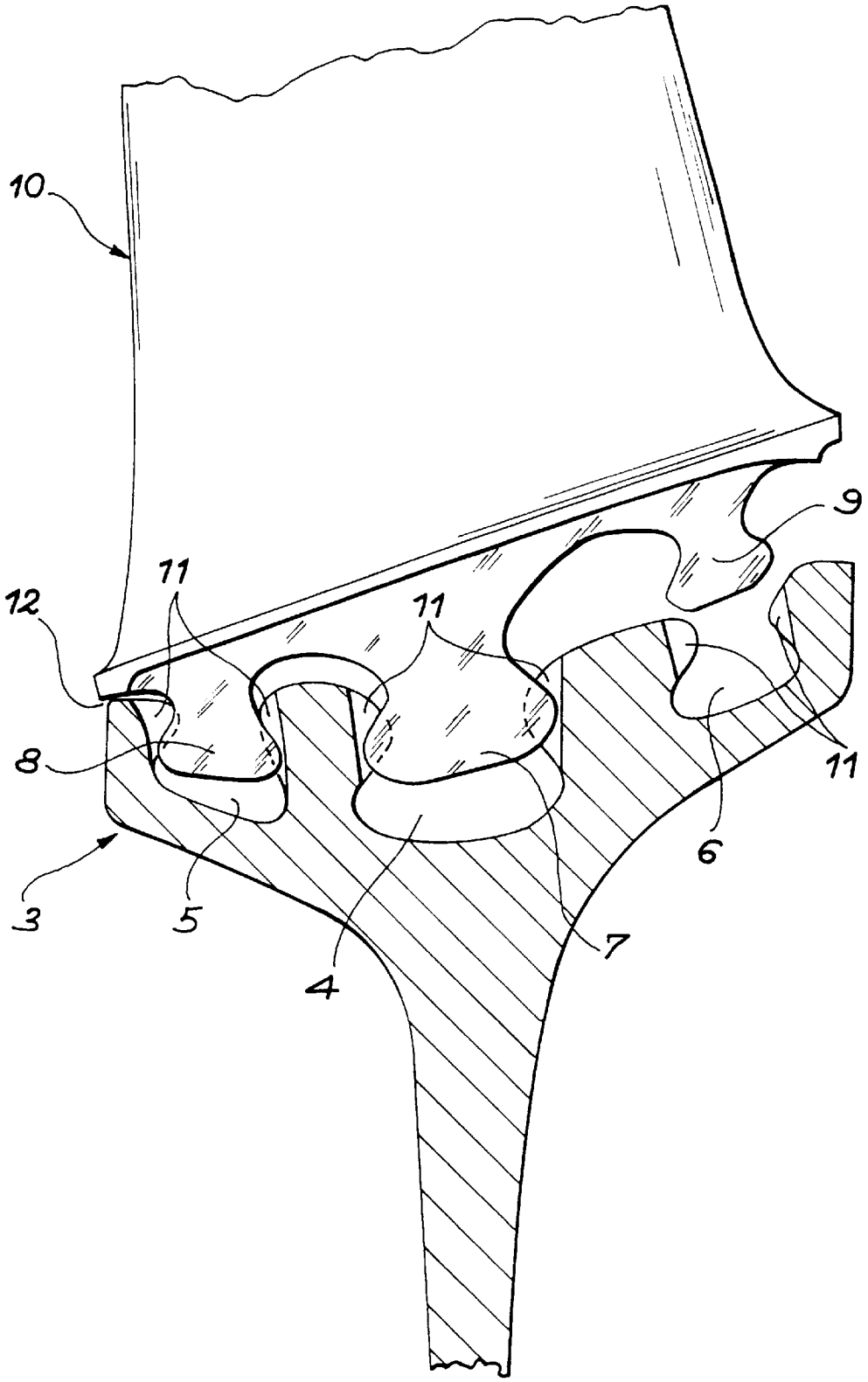
FIG. 4 illustrates a mode of inserting the blades.

FIG. 4 illustrates a mode of assembling the blades 10: slots 11 of radial direction are made on the outer ring 3 in such a way as to enlarge the grooves 4, 5 and 6 locally in order to make them wider than the roots 7, 8 and 9 and in order to insert them. The insertion movement of the blades may be purely radial or, as represented here, may be achieved by rotating the blade 10 around a pivot point 12 defined by the contact of a side of the blade 10 and the ring 3. In both cases, the blades 10 are locked by sliding the roots 7, 8 and 9 into their groove 4, 5 and 6 after insertion so that they leave the sector of the slots 11.

FIG. 5 represents a plastic, arc-shaped shock-absorbing element 13, whose extremities 14 rest on the bottom 15 of any one of the grooves 4, 5 and 6 and whose median part 16 is inserted under the root of a blade 10, and maintained under this root despite the risk of the element 13 moving along the groove, thanks to two raised edges 17 which grip the root of the blade. The vibrations of radial direction to which the blade 10 is subjected cause the element 13 to be squeezed and relaxed, thus allowing it to dissipate energy. A lobe 18 is advantageously provided under the median part 16 so as to stop against the bottom 15 of the groove when the squeezing of the element 13 has reached a limit which is not to be exceeded.

We claim:

1. Bladed disk (1) fitted with an outer ring of blades (10), characterized in that it is cut by three circular grooves (4, 5 and 6) which are respectively penetrated, for each of the blades (10), by three blade roots (7, 8 and 9) situated at different angles of the disk and directed along a rotation axis (X) of the disk, and in that the grooves (4, 5, 6) have different sections and in that the blade roots (7, 8, 9) also have different sections.

2. Bladed disk according to claim 1, characterized in that the grooves are situated at different distances from the rotation axis of the disk.

3. Bladed disk according to claim 1, characterized in that shock-absorbers (13) are placed between the blade roots (10) and the groove bottoms (15).

4. Bladed disk according to claim 3, characterized in that the shock-absorbers consist of arched and elastic blades having extremities resting on the groove bottoms, a median part (16) resting on the blade roots, and a lobe (18) serving as clearance stop attached under the median part (16) and directed towards the groove bottoms.

* * * * *